US012366246B2

(12) United States Patent
Andreis et al.

(10) Patent No.: US 12,366,246 B2
(45) Date of Patent: Jul. 22, 2025

(54) PUMP PARTICULARLY FOR PUMPING ABRASIVE AND/OR CHEMICALLY AGGRESSIVE LIQUIDS

(71) Applicant: FLUID-O-TECH S.R.L., Milan (IT)

(72) Inventors: Diego Andreis, Milan (IT); Pierpaolo Lucchesi, Milan (IT); Stefano Copelli, Milan (IT); Carlo Gonella, Cuneo (IT)

(73) Assignee: FLUID-O-TECH S.R.L., Milan (IT)

( * ) Notice: Subject to any disclaimer, the term of this patent is extended or adjusted under 35 U.S.C. 154(b) by 0 days.

(21) Appl. No.: 17/230,458

(22) Filed: Apr. 14, 2021

(65) Prior Publication Data

US 2021/0396227 A1 Dec. 23, 2021

(30) Foreign Application Priority Data

Jun. 23, 2020 (IT) ..... 102020000015058

(51) Int. Cl.

| | |
|---|---|
| ***F04C 13/00*** | (2006.01) |
| ***F04C 2/08*** | (2006.01) |
| ***F04C 2/18*** | (2006.01) |
| ***F04C 2/24*** | (2006.01) |

(52) U.S. Cl.

CPC ..... *F04C 13/002* (2013.01); *F04C 2/08* (2013.01); *F04C 2230/60* (2013.01); *F04C 2240/30* (2013.01); *F04C 2240/60* (2013.01)

(58) Field of Classification Search

CPC ..... F04C 13/0002; F04C 2/08; F04C 2/082; F04C 2/24; F04C 2/18; F04C 18/082; F04C 18/084

See application file for complete search history.

(56) References Cited

U.S. PATENT DOCUMENTS 5,531,537 A * 7/1996 Pink ..... F16D 1/0858 418/179
6,206,667 B1 * 3/2001 Turner, Jr. ..... F04C 13/002 418/179

(Continued)

FOREIGN PATENT DOCUMENTS

AU 2007221859 A1 * 4/2009 ..... F04C 11/008
CN 1603622 A 4/2005

(Continued)

OTHER PUBLICATIONS

Datasheet Bonggoo Kim, Sep. 2012.*

(Continued)

*Primary Examiner* — Deming Wan
(74) *Attorney, Agent, or Firm* — CANTOR COLBURN LLP

(57) ABSTRACT

A pump particularly for pumping abrasive and/or chemically aggressive liquids includes at least one rotating pumping member having a respective shaft, the at least one rotating pumping member being at least partially housed inside a pump body. The shaft is rotatably supported by at least one support associated with the pump body.

The shaft and the at least one support are both at least partially made of a material having a hardness greater than or equal to 5 Mohs, where the material having a hardness greater than or equal to 5 Mohs is located at least in the areas of the shaft and of the support in mutual contact.

10 Claims, 5 Drawing Sheets

(56) References Cited

U.S. PATENT DOCUMENTS

| | | | | |
|---|---|---|---|---|
| 2001/0035012 | A1* | 11/2001 | Smith | B60K 7/0015 60/435 |
| 2005/0152790 | A1* | 7/2005 | Arbogast | F04C 15/008 417/355 |
| 2006/0024188 | A1* | 2/2006 | Muscarella | F04C 15/0088 418/206.1 |
| 2006/0288560 | A1* | 12/2006 | Shafer | F04C 15/0069 29/446 |
| 2011/0048384 | A1* | 3/2011 | O'Shea | F02M 37/04 123/495 |
| 2017/0058895 | A1* | 3/2017 | Schultz | F04C 15/0073 |
| 2018/0045197 | A1* | 2/2018 | Henry | F04C 15/0073 |
| 2018/0347563 | A1 | 12/2018 | Wollmann | |

FOREIGN PATENT DOCUMENTS

| | | | | | |
|---|---|---|---|---|---|
| CN | 104976113 | A | * | 10/2015 | |
| CN | 108150410 | A | * | 6/2018 | F04C 13/001 |
| CN | 208564955 | U | * | 3/2019 | F04C 18/084 |
| JP | H11230055 | A | | 8/1999 | |
| JP | 3602275 | B2 | | 12/2004 | |
| JP | 2008075803 | A | * | 4/2008 | F16C 33/62 |
| JP | 2019044698 | A | * | 3/2019 | F04C 18/16 |

OTHER PUBLICATIONS

English translation of CN108150410 by PE2E Oct. 27, 2022.*
English translation of CN104976113 by PE2E Oct. 27, 2022.*
English translation of JP2019044698 by PE2E Apr. 5, 2024.*
English translation of JP2008075803 by PE2E Apr. 5, 2024.*
English translation of CN 208564955 by PE2E Apr. 5, 2024.*
Anonymous "Mohs Hardness Scale", Oct. 21, 2020, URL:https://www.rockrollers.com/features/hardness.htm, XP055742283.
Anonymous "StarCeram S Sintered Silicon Carbinde (SSiC)—Silicon Carbide—Matmatch", Oct. 21, 2020, XP055742249.
IT Search Report issued Oct. 22, 2020 re: Application No. IT 202000015058, pp. 1-24, citing: US 2018/0347563 A1, JP H11 230055 A, Rosler "Comparison of Material . . . ", Anonymous "Mohs Hardness Scale", Anonymous "StarCeram S Sintered Silicon . . . ", JP 3 602275 B2.
Rosler "Comparison of Material Between Hardness (MOHs) and Vickers Hardness or Rockwell "C" Scales : roslerblog", Feb. 26, 2016, URL:https://roslerblog.com/2016/02/26/mohs-vickers-hardness-prockwell, XP055742241.
European Office Action for Application No. 21167994.9, dated Jan. 30, 2025, 5 pages.

* cited by examiner

PUMP PARTICULARLY FOR PUMPING ABRASIVE AND/OR CHEMICALLY AGGRESSIVE LIQUIDS

CROSS REFERENCE TO RELATED APPLICATIONS

This application is related to and claims the benefit of Italian Patent Application No. 102020000015058, filed on Jun. 23, 2020, the contents of which are herein incorporated by reference in their entirety.

TECHNICAL FIELD

The present disclosure relates to a pump particularly for pumping abrasive and/or chemically aggressive liquids, such as inks, paints, glues or the like.

BACKGROUND

The devices suitable for pumping inks, paints, glues or similar liquids generally comprise a pump, often of the volumetric type, intended to pump such liquids into the hydraulic circuits of such devices.

For instance, referring to the printing sector, pumps for inks used in ink printers, such as inkjet printers, can be mentioned. As known there exists a plurality of different inks which vary depending on the printer characteristics, on the material to be printed, on the drying rate of the ink, on the pigment used in the ink and on several other factors.

In the paint sector, the pumps are instead used for instance in devices for dosing paint. As for the inks, there exists a plurality of different paints with different physical properties suitable for specific applications.

Due to their composition, inks and paints often have abrasive characteristics which, over time, tend to wear the components of the pump which they contact, jeopardising considerably the performances of the pumps and reducing the service life thereof.

Furthermore, the solvents generally present in inks and paints are chemically aggressive substances which attack the components of the pumps they contact, further jeopardising the performances of the pumps and reducing the service life thereof.

Such problems certainly relate to inks and paints, as well as glues and other types of liquids which have abrasive properties and/or which contain chemically aggressive substances.

SUMMARY

The main task of the present disclosure relates to making a pump, particularly for pumping abrasive and/or chemically aggressive liquids, which overcomes the above set forth drawbacks of the prior art allowing to safeguard the pump performances and lengthen the service life thereof, without significantly affecting the production costs of the pump itself.

Within the scope of this task, the present disclosure provides a pump which does not wear out prematurely or blocks while in use.

The disclosure further relates to making a pump that is easy to make and assemble.

The disclosure further provides a pump that is able to provide the broadest guarantees of reliability, durability and security when used.

The disclosure also relates to providing a pump that is economically competitive if compared to the prior art.

The above set forth task, as well as the advantages mentioned and others that will better appear later, are obtained by providing a pump, particularly for pumping abrasive and/or chemically aggressive liquids as claimed in claim 1.

Other features are comprised in the dependent claims.

BRIEF DESCRIPTION OF THE DRAWINGS

Further characteristics and advantages will be more apparent from the description of a preferred embodiment, though non-exclusive, of a pump, particularly for pumping abrasive and/or chemically aggressive liquids, shown for exemplary and non-limiting purposes with the aid of the enclosed drawings wherein.

DETAILED DESCRIPTION OF THE DRAWINGS

Figure 1:
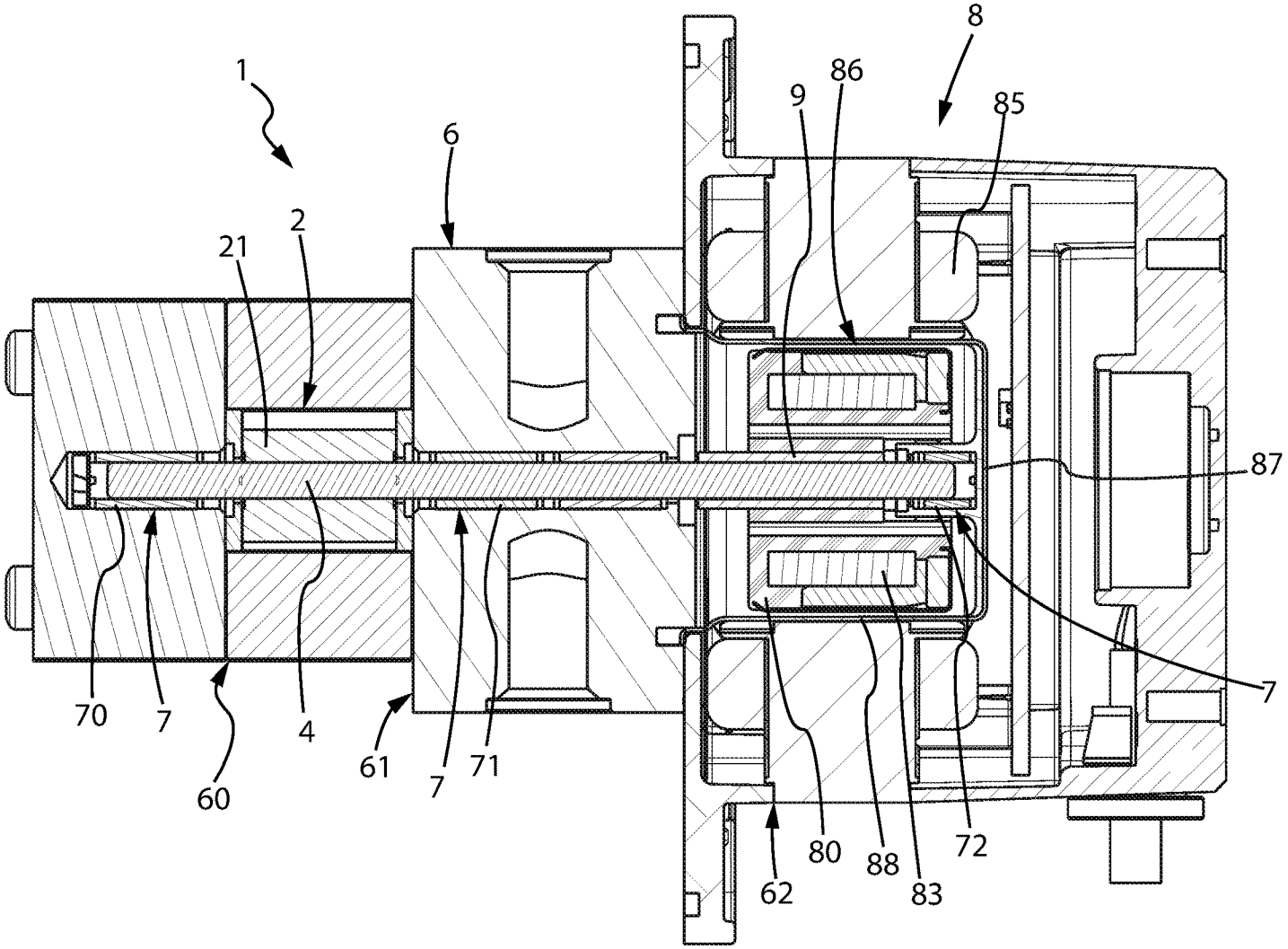
FIG. 1 is a section longitudinal view of an embodiment of a pump according to the disclosure.
Figure 2:
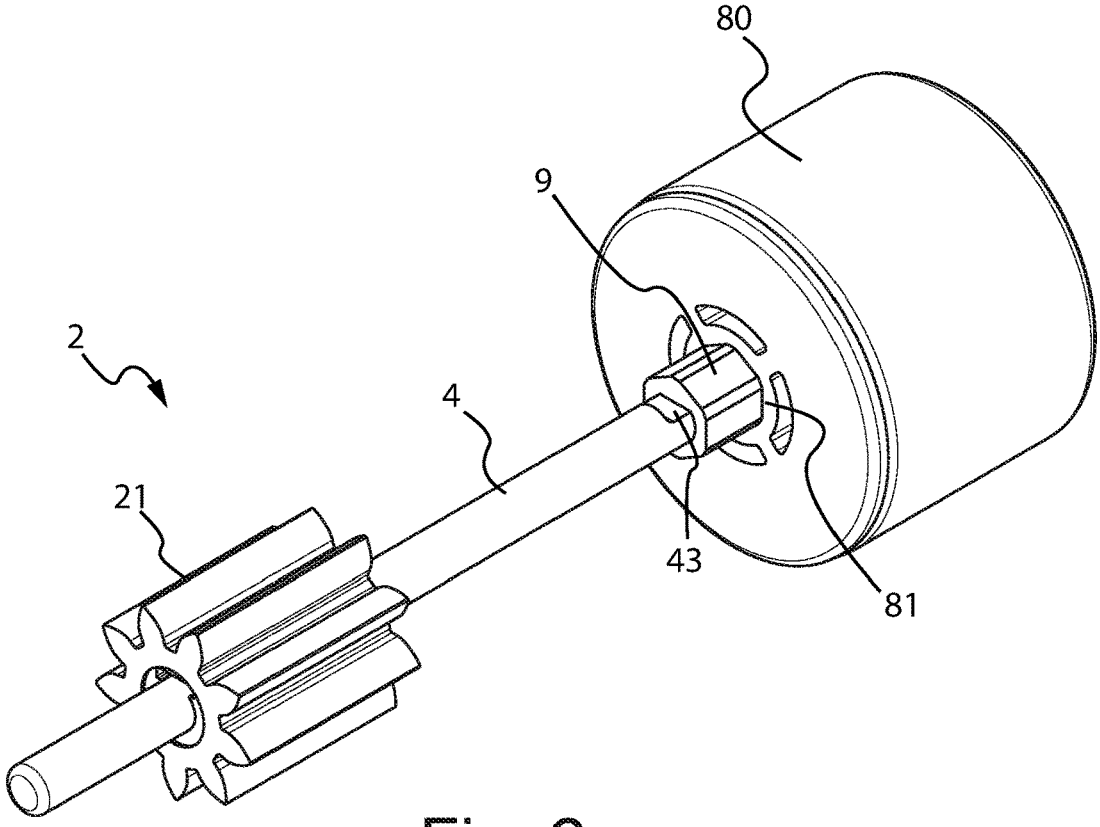
FIG. 2 is a perspective view of some components of the pump according to the disclosure, and in particular of the motion transmission shaft, of the relative gear wheel and of the rotating driving member of the shaft.
Figure 3:
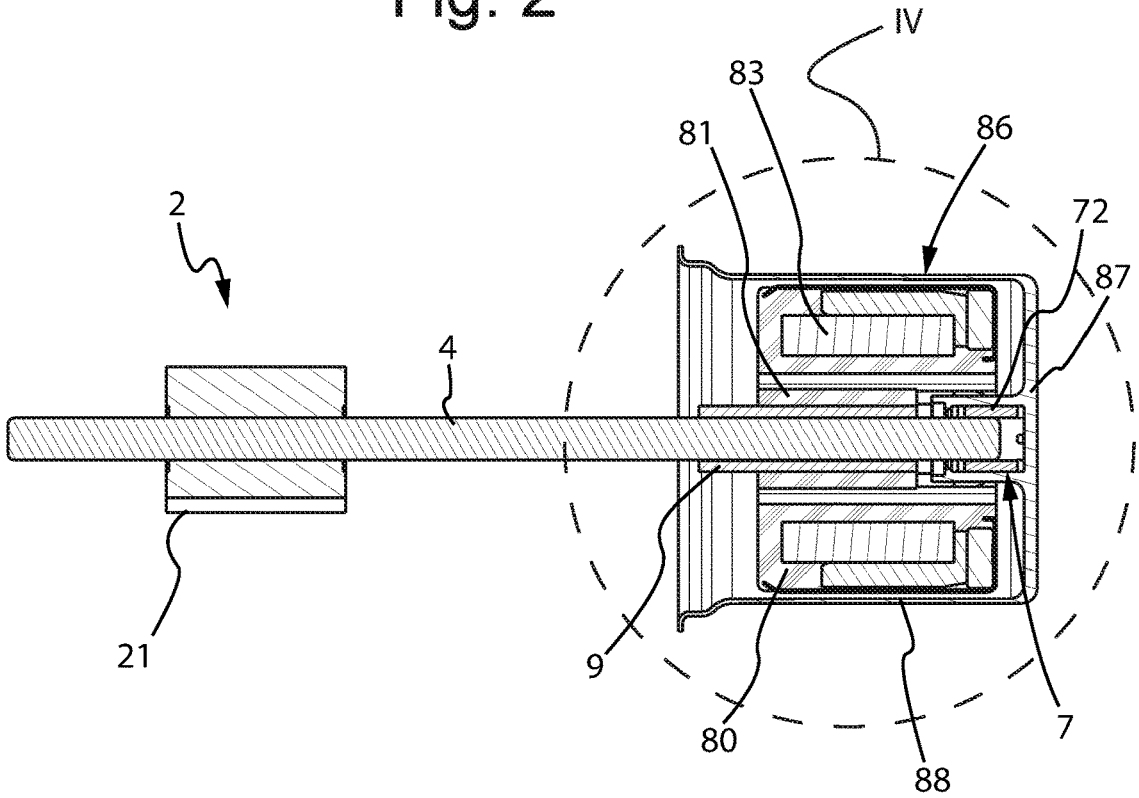
FIG. 3 is a longitudinal section view of some components of the pump according to the disclosure, and in particular of the motion transmission shaft, of the relative gear wheel and of the rotating driving member of the shaft housed in the relative cap.
Figure 5:
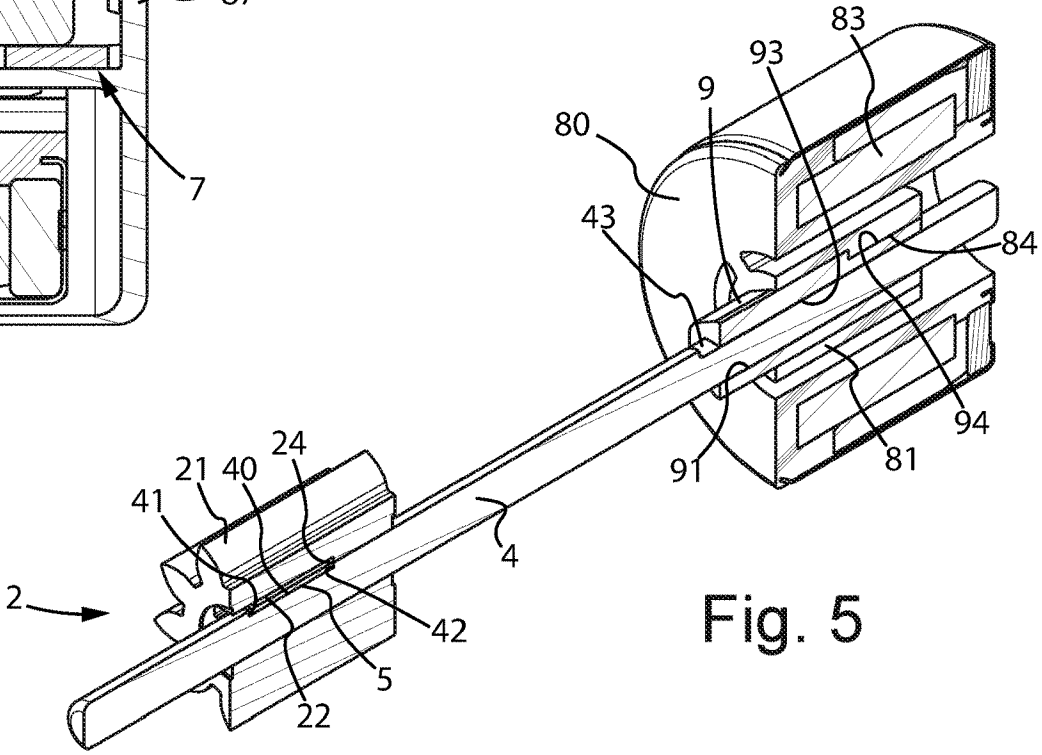
FIG. 5 is a section perspective view of the components of the pump shown in FIG. 2.
Figure 4:
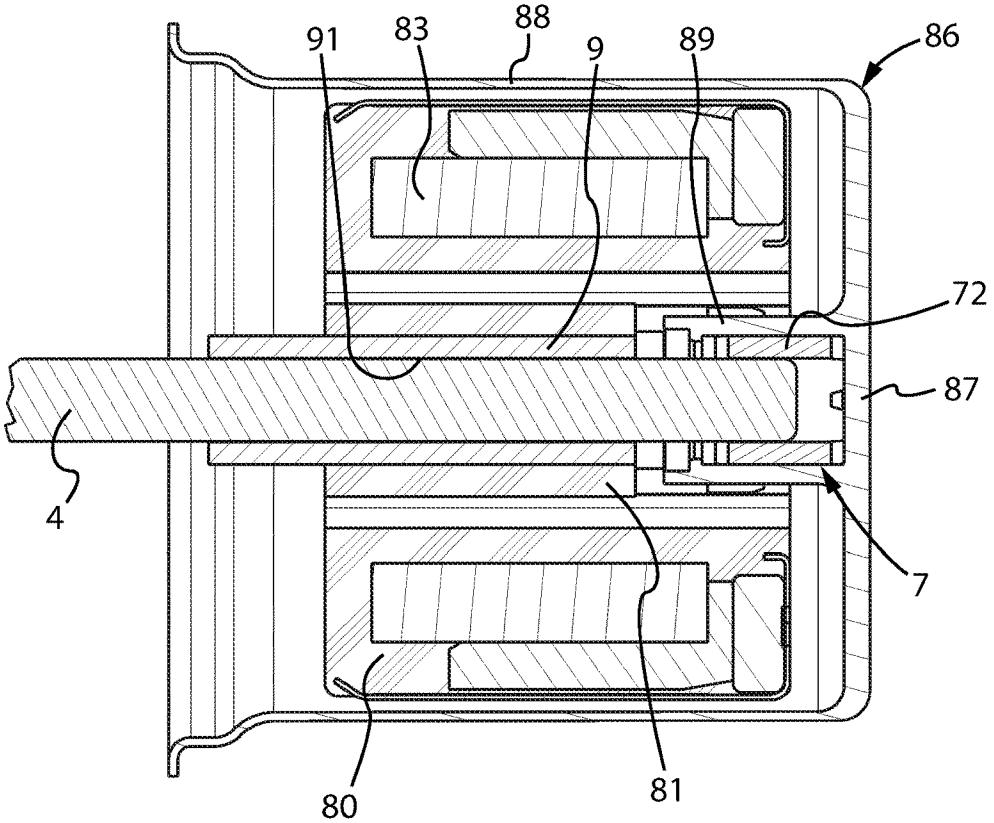
FIG. 4 is an enlarged view of the portion of FIG. 3 indicated by IV.
Figure 6:
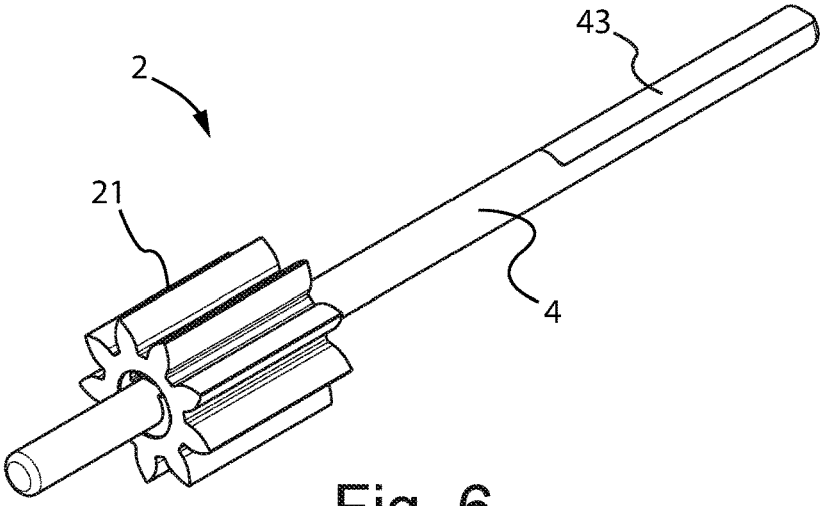
FIG. 6 is a perspective view of the shaft with relative gear wheel present in the pump according to the disclosure.
Figure 7:
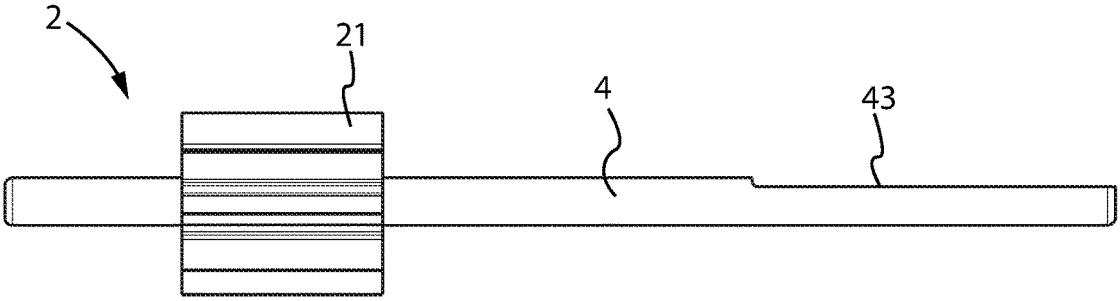
FIG. 7 is a side elevation view of the shaft with relative gear wheel shown in FIG. 6.
Figure 8:
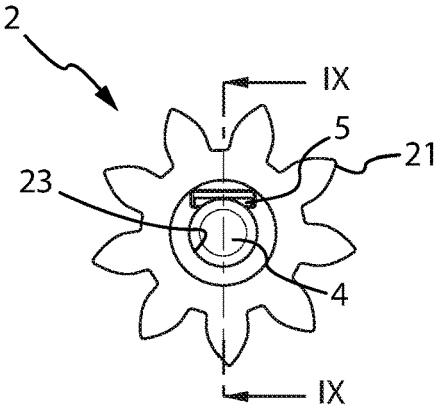
FIG. 8 is a front elevation view of the shaft with relative gear wheel present in the pump according to the disclosure.

Referring to the mentioned figures, the pump, particularly for pumping abrasive and/or chemically aggressive liquids such as inks, paints, glues or the like, globally indicated with reference number 1, comprises at least a rotating pumping member 2 comprising a respective shaft 4. The at least one rotating pumping member 2 is at least partially housed inside a pump body 6. The shaft 4 is rotatably supported by at least a support 7 associated to the pump body 6.

According to the disclosure, the shaft 4 and the at least one support 7 are both at least partially made of a material having a hardness greater than or equal to 5 Mohs, where said material having a hardness greater than or equal to 5 Mohs is located at least in the areas of the shaft 4 and of the support 7 in mutual contact.

Advantageously, such material which can be used, as described hereinafter, also for other components of the pump 1, has a hardness greater than or equal to 6 Mohs, and still more preferably greater than or equal to 6.5 Mohs.

Advantageously, said material having a hardness greater than or equal to 5 Mohs further has one of the following properties:

Weibull modulus between 3 and 20;

Young's modulus greater than or equal to 50 GPa;

tensile strength at 20° C. greater than or equal to 30 MPa.

Preferably, such material has all the three above listed properties.

Advantageously, said material having a hardness greater than or equal to 5 Mohs further has one or more of the following properties:

thermal conductivity at 20° C. greater than or equal to 0.1 W/(m*K);

maximum operating temperature greater than or equal to 250° C.

Preferably, such material has all the two above listed properties.

Still more preferably, such material has all the five above listed properties.

Advantageously the shaft 4 and the at least one support 7 are entirely made of said material having a hardness greater than or equal to 5 Mohs.

Therefore, such material may be used as a surface coating of the areas of components in mutual contact, or as a material for manufacturing the solid or alloyed component in its entirety. Thus, substantially, the shaft 4 and the at least one support 7 are each made in a single piece of a single material having a hardness greater than or equal to 5 Mohs, (or, as said above, preferably greater than or equal to 6 Mohs, and still more preferably greater than or equal to 6.5 Mohs).

Advantageously, the same type of material can indeed be used for the shaft 4 and for the relative support 7 so as to optimise the tribological compatibility between the components in mutual contact, as well as the thermal compatibility.

Advantageously the shaft 4 is supported by a plurality of supports 7, mutually spaced apart between them along the direction of longitudinal development, or axial direction, of the shaft 4. Advantageously all the supports 7 of said plurality of supports 7 are at least partially made of said material having a hardness greater than or equal to 5 Mohs.

Advantageously at least one of the supports 7 is arranged at an axial end of the shaft 4.

Preferably the pump 1 comprises at least a pair of supports 7 of the shaft 4 arranged at the two axial ends of the shaft 4.

Advantageously the pump 1 may be a volumetric pump, for instance a lobe pump, a vane pump, or a pump with inner or outer gear wheels.

The example shown in FIG. 1 relates to a volumetric gear wheel pump 1 which comprises a pair of rotating pumping members, and in particular a driven rotating pumping member 2 and an idle rotating pumping member, not visible in FIG. 1. In this case the rotating pumping members 2 each comprise a gear wheel 21 associated to the respective shaft, that is the driven shaft 4 and the idle shaft, the latter not visible in FIG. 1.

Advantageously, therefore, the pump 1 comprises a pair of rotating pumping members 2 each comprising a shaft 4 and a gear wheel 21 associated to the respective shaft 4, where the gear wheels 21 of said pair of rotating pumping members 2 are mutually meshed.

Advantageously both shafts 4, both gear wheels 21 and each support 7 are at least partially made of said material having a hardness greater than or equal to 5 Mohs, (or, as said above, preferably greater than or equal to 6 Mohs, and more preferably greater than or equal to 6.5 Mohs) where said material is located at least in the areas of the shafts 4 and of the relative supports 7 in mutual contact and at least in the areas in mutual contact of the gear wheels 21, that is at the teeth of the wheels.

Advantageously the driven and/or idle gear wheel 21 may be made in a single piece with the respective shaft 4, or the driven and/or idle gear wheel 21 may be fitted in the respective shaft 4.

In an alternative embodiment not shown in the enclosed figures, the pump may be a centrifugal pump. In this case the rotating pumping member may comprise an impeller, or a turbine, fitted in the respective shaft, or made in a single piece with the shaft. In this case, both the shaft and the impeller may be made of said material having a hardness greater than or equal to 5 Mohs.

The gear wheel 21 can be associated to the respective shaft 4 by means of a tab 5 or a key, interposed between faces of the mutually facing gear wheel 21 and the shaft 4.

Advantageously the gear wheel 21 comprises a longitudinal through hole 23 crossed by the shaft 4. The shaft 4 comprises a seat 40 obtained on its outer cylindrical surface, while the gear wheel 21 has a seat 22 obtained on the inner cylindrical surface of its longitudinal through hole 23. In the assembled configuration of gear wheel 21 and shaft 4, the seat 22 and the seat 40 are mutually facing so as to house at the same time the tab 5, which has such shapes and dimensions that a first portion thereof is housed in the seat 22 and one second portion thereof is simultaneously housed in the seat 40.

Figure 9:
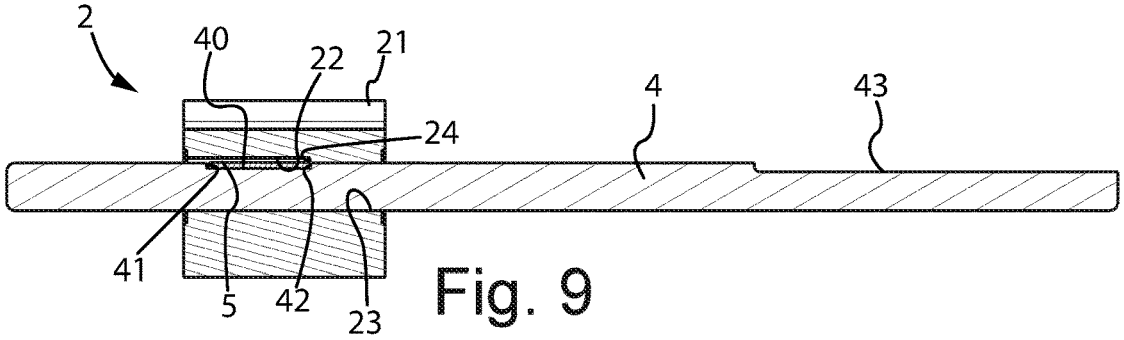
FIG. 9 is a section view of the shaft with relative gear wheel represented in FIG. 8 carried out according to the axis IX-IX.

Advantageously, as shown in FIG. 9, the seat 40 obtained in the shaft 4 is configured so as to block the movement of the tab 5 along the axial direction of the shaft 4 in both directions. In other words, the seat 40 has two opposite walls 41, 42 which serve as an axial abutment for the tab 5.

The seat 22 obtained in the gear wheel 21 has on the contrary one single axial abutment wall 24 for the tab 5, so as to enable inserting the tab 5 between gear wheel 21 and shaft 4 during the step of assembling such components.

As shown in FIG. 1, when the entire pump 1 is completely assembled, the possible slipping out of the gear wheel 21 from the shaft 4 is prevented by the presence of the central portion 61 of the pump body 6.

Advantageously the mechanical connection between gear wheel 21 and shaft 4 provided by the tab 5 also comprises using the glue or other blocking substances.

Using the glue or another blocking substance is particularly useful to prevent the gear wheel 21 from slipping out from the shaft 4 during the steps of assembling the pump 1.

Advantageously the tab 5, or key, is also made of a material having a hardness greater than or equal to 5 Mohs (or, as said above, preferably greater than or equal to 6 Mohs, and still more preferably greater than or equal to 6.5 Mohs).

Advantageously, the pump 1 comprises motion actuation means 8 adapted to rotate the shaft 4.

Such motion actuation means 8 may comprise a motor, preferably electric, direct-driven on the shaft 4, or a motor, preferably electric, magnetically driven, as in the case of the embodiment of the pump 1 shown in FIG. 1.

The motion actuation means 8 comprise a rotating member 80 coupled to the shaft 4 by means of a coupling element 9 interposed between the shaft 4 and the hub 81 of the rotating member 80 and configured to constrain in rotation the shaft 4 to the rotating member 80.

Advantageously also the coupling element 9 and/or the hub 81 are at least partially made of said material having a hardness greater than or equal to 5 Mohs (or, as said above, preferably greater than or equal to 6 Mohs, and still more preferably greater than or equal to 6.5 Mohs).

Advantageously the coupling element 9 comprises an axial hole 91 inside which the shaft 4 is inserted, and it can in turn be inserted in the hub 81 of the rotating member 80. The shaft 4 advantageously comprises on its cylindrical outer surface at least a grooved profile 43 configured to couple with at least a corresponding protruding profile 93 present on the inner cylindrical surface of the hole 91 of the coupling element 9. The hub 81 advantageously comprises, on its inner cylindrical surface, at least a protruding profile 84 configured to couple with at least a corresponding groove 94 obtained in outer cylindrical surface of the coupling element 9. The coupling element 9 thereby constrains in rotation the rotating member 80 to the shaft 4.

In alternative, the coupling element 9 may be defined by a key or a tab.

In a further alternative, both shaft 4 and hub 81 comprise complimentary grooves and are directly coupled with each other. In this case both the shaft 4 and the hub 81 are at least partially made of said material having a hardness greater than or equal to 5 Mohs (or, as said above, preferably greater than or equal to 6 Mohs, and still more preferably greater than or equal to 6.5 Mohs).

Advantageously, as shown in the enclosed figures, the coupling element 9 and/or the hub 81 are completely made of said material having a hardness greater than or equal to 5 Mohs (or, as said above, preferably greater than or equal to 6 Mohs, and still more preferably greater than or equal to 6.5 Mohs).

As shown in the embodiment of the pump 1 of FIG. 1, the rotating member 80 comprises an inner magnet 83 adapted to be driven in rotation by an outer magnet 85 connected to the motor of the pump 1.

Using a material having a hardness greater than or equal to 5 Mohs for the shaft 4, the hub 81 and the coupling element 9, and preferably using indeed the same type of material, allows to obtain a more rigid connection between such components. Furthermore, by using suitably selected coupling tolerances, it is possible to avoid wear due to the presence of the abrasive fluid inside the coupling between said components.

The support element 7 of the shaft 4 comprises at least a bush 70, 71, 72, made in said material having a hardness greater than or equal to 5 Mohs (or, as said above, preferably greater than or equal to 6 Mohs, and still more preferably greater than or equal to 6.5 Mohs), and preferably made indeed of the same material as the shaft 4.

Advantageously said at least a bush 70, 71, 71 is kept in position inside a corresponding housing seat 66 present in the pump body 6 by a deformed portion 65 of the material of which the pump body 6 is formed, where such deformed portion is deformed by means of crimping or riveting tools 99.

The pump 1 advantageously comprises a central bush 71 adapted to rotatably support the shaft 4 in a central portion thereof.

Advantageously, the pump 1 may also comprise a pair of end bushes 70 and 72 arranged at the axial ends of the shaft 4.

As shown in the embodiment of the pump 1 of FIG. 1, the pump body 6 is defined by a first end body 60 where the gear wheels 21 are housed, by a central body 61, and by a second end body 62 which contains motion actuation means 8.

As said, the pump 1 comprises at least a central bush 71 in the central body 61, which constitutes the main rotation support 7 of the shaft 4, and can further comprise one or two end bushes 70 and 72, respectively present in the first end body 60 and in the second end body 62.

As shown in FIG. 1, the rotating body 80 comprising the inner magnet 83 may be housed inside a cap 86, which has a bottom 87 and a cylindrical wall 88. In this case the end bush 72 is fixed to the bottom 87 of the cap 86, at a housing seat 89 of the bush 72 obtained in the bottom 87 of the cap 86 itself.

Figure 12:
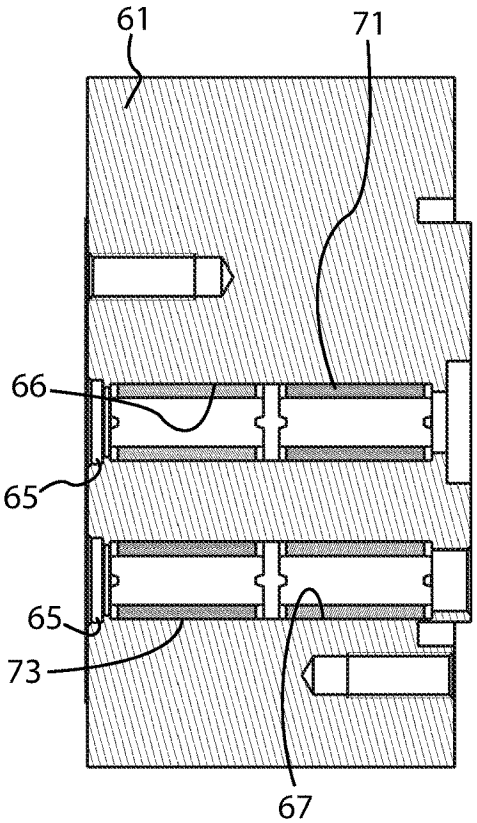
FIGS. 10 to 12 represent a processing sequence of the central portion of the pump body for inserting some supports of the shaft, in a pump according to the disclosure.
Figure 11:
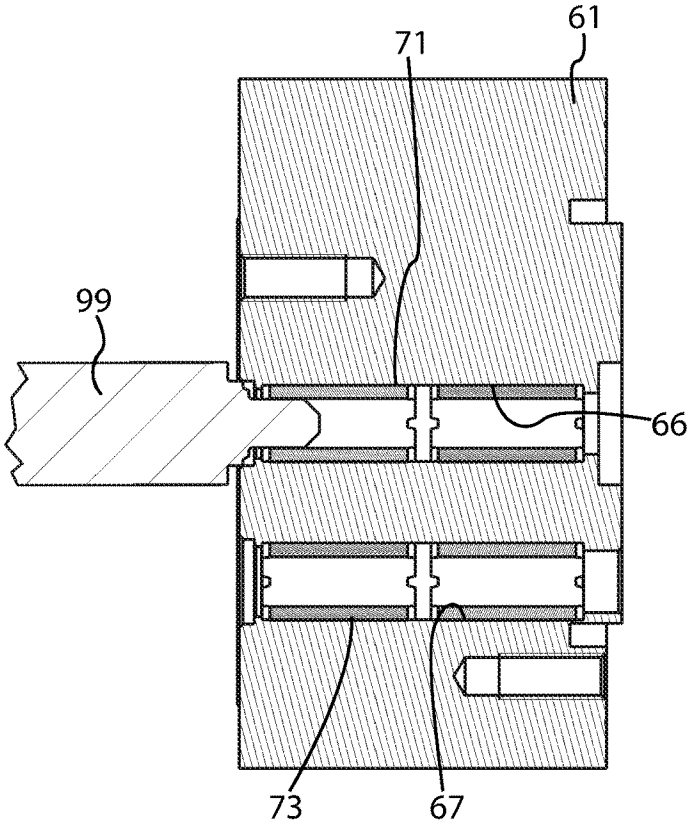
Figure 10:
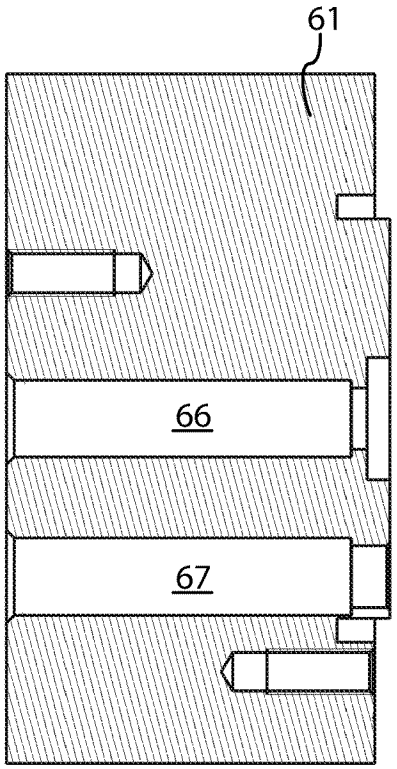

In FIGS. 10 to 12 some steps of inserting and blocking the main bush 71 inside the housing seat 66 present in the central body 61 of the pump body 6 are shown.

In such figures it is also visible the housing seat 67 for the additional bushes 73 which support the idle shaft, not shown in the remaining figures.

In particular, in FIG. 11 it is shown the step wherein the riveting tool 99 is used to deform the portion of material 65 of which the central body 61 of the pump body 6 is made, in order to obtain the deformed portion 65, shown in FIG. 12 and adapted to fix the bushes 71 and 73 in position.

Generally the bushes supporting the shaft are made of technopolymers and are inserted and blocked inside the respective seats, exploiting the mechanical property of technopolymers which deform without yielding. Such inserting and blocking mode cannot be performed in case of supports 7 made of said material having a hardness greater than or equal to 5 Mohs (or, as said above, preferably greater than or equal to 6 Mohs, and more preferably greater than or equal to 6.5 Mohs).

The above described insertion and fixing of the bushes 71, 73 allows to reduce costs for processing and assembling such components, not requiring at the same time to manage too small tolerances.

The present disclosure further relates to a process for assembling a pump 1 particularly for pumping abrasive and/or chemically aggressive liquids, comprising at least one rotating pumping member 2 comprising a respective shaft 4, wherein said at least one rotating pumping member 2 is at least partially housed inside a pump body 6, wherein the shaft 4 is rotatably supported by at least one support 7 associated with the pump body 6, where said shaft 4 and said at least one support 7 are both at least partially made of a material having a hardness greater than or equal to 5 Mohs (or, as said above, preferably greater than or equal to 6 Mohs, and more preferably greater than or equal to 6.5 Mohs), and where said material is located at least in the areas of the shaft 4 and of the support 7 in mutual contact, and wherein such support 7 comprises at least a bush 70, 71, 72.

According to the disclosure, the process comprises the steps of:

- inserting said at least a bush 70, 71, 72 inside a corresponding housing seat 66 present in said pump body 6;
- deforming the portion of material 65 of which said pump body 6 is made at said housing seat 66, an in particular at the opening of the housing seat 66 through which said at least a bush 70, 71, 72 is inserted to fix said at least a bush 70, 71, 72 in the aforesaid housing seat 66.

Advantageously, the step of deforming the portion of material 65 of said pump body 6 at the housing seat 66 is performed by means of a crimping or riveting tool.

Advantageously, said material having a hardness greater than or equal to 5 Mohs may comprise one or more of the following materials:

- Oxides, such as $SiO_2$, $Al_2O_3$, $ZrO_2$, MgO, $BaTiO_3$, $Al_2O_3$:Cr, $Al_2TiO_5$;
- Nitrides, such as $Si_3N_4$;
- Carbides, such as B4C, WC, TiC, SiC, TaC, NbC, $Cr_3C_2$;

Allotropes of carbon, such as diamond, lonsdaleite, graphene, nanotubes;

Fluorides, such as $CaF_2$

Hydroxyapatite;

Clays, such as kaolin;

Silicates, such as lithium aluminium silicate.

For example the material used for the shaft 4, the supports 7 and possibly also one or more of the following components of the pump 1: tab 5, hub 81, coupling element 9, may be a cemented carbide comprising one or more of tungsten carbide, titanium carbide and tantalum carbide, silica carbide, and incorporated in a metal matrix, preferably of cobalt.

In addition, for example, the material used for the shaft 4, the supports 7 and also possibly for one or more of the following components of the pump 1: tab 5, hub 81, coupling element 9, may be a silica nitride or another highly-hard synthetic material, such as corundum, ruby, sapphire, emerald, alexandrite, diamond.

It was in fact proven that the pump, particularly for pumping abrasive and/or chemically aggressive liquids, according to the present disclosure, meets the task as well as the predetermined objects in that the adoption of a hard material, such as cemented carbide, to manufacture one or more of the main components of the pump, together with excellent tribological properties, ensures a longer service life of the pump components, significantly limiting the wear and lengthening as a whole the service life of the pump.

The pump according to the disclosure is able to significantly limit abrasive wear events afflicting the components which contact abrasive liquids, and in particular (i) two-body abrasion wear events, caused by the abrasive particles transported inside the fluid, (ii) three-body abrasive wear events, caused by the passage of abrasive particles inside a fluid flowing between two surfaces in mutual contact and (iii) tribo-oxidative wear events which occur in case of oxidation and corrosion of the surfaces, where abrasive wear acts removing the oxide formed and/or the products of corrosion, leaving the innermost surface of the components exposed.

Furthermore, the adoption of such a hard material, also preferably characterised by an excellent thermal conductivity, allows the pump, as a whole, to better dissipate heat while in use.

Further, the use of a similar, or at least a compatible, material for pump components in mutual contact, such as preferably the shaft and the related supports, allows to prevent such components, submitted to even significant thermal excursions, from having different deformation gradients, which may lead to the reduction of desired tolerances and therefore worsen the pump performance, or even block it.

At the same time, some technical expedients among those described above allow to assemble, in a simple and easy but at the same time long-lasting way, the pump components keeping the overall industrial cost at acceptable levels.

The pump particularly for pumping abrasive and/or chemically aggressive liquids is susceptible to several modifications and variants all falling within the inventive concept of the disclosure.

Furthermore, all the details can be replaced by other technically equivalent elements.

In practice, any materials can be used according to requirements, as long as they are compatible with the specific use, the dimensions and the contingent shapes.

The invention claimed is:

1. A pump for pumping abrasive and/or chemically aggressive liquids, the pump comprising: a pump body having one single pumping chamber inside which at least one rotating pumping member is at least partially arranged, said at least one rotating pumping member comprising a respective shaft, said at least one rotating pumping member being at least partially housed inside a pump body, said shaft being rotatably supported by at least one support associated with said pump body, wherein said shaft and said at least one support are both completely made of a material having a hardness greater than or equal to 6.5 Mohs, said pump comprising an inner magnet adapted to be driven in rotation by a magnetic field generated by an electric part of a motor or driven in rotation by an outer magnet connected to a motor of said pump, said inner magnet driving in rotation said shaft of said at least one rotating pumping member, said pump further comprising a plurality of supports mutually spaced apart along the direction of the longitudinal development of said shaft, where all the supports of said plurality of supports are completely made of said material having a hardness greater than or equal to 6.5 Mohs, and said plurality of supports comprise a central bush adapted to rotatably support said shaft in a central portion and a pair of end bushes arranged at the axial ends of said shaft.

2. The pump according to claim 1, wherein said shaft and said at least one support are each made in a single piece of a single material having a hardness greater than or equal to 6.5 Mohs.

3. The pump, according to claim 2, wherein said gear wheel is associated with the respective shaft by a tab or a key, made of said material having a hardness greater than or equal to 6.5 Mohs, interposed between faces of said gear wheel and of said shaft facing each other.

4. The pump, according to claim 1, further comprising a pair of rotating pumping members, each rotating pumping member comprising a shaft and a gear wheel associated with the respective shaft, each of the respective shaft being rotatably supported by at least one support associated with said pump body, said gear wheels of said pair of rotating pumping members being mutually meshed, both said shafts, both said gear wheels and each of said supports being completely made of said material having a hardness greater than or equal to 6.5 Mohs.

5. The pump, according to claim 1, further comprising motion actuation component adapted to rotate said shaft, said motion actuation component comprising a rotating member coupled to said shaft by a coupling element interposed between said shaft and a hub of said rotating member and configured to constrain in rotation said shaft to said rotating member, said coupling element and/or said hub being at least partially made of said material having a hardness greater than or equal to 6.5 Mohs, wherein said rotating member supports said inner magnet.

6. The pump, according to claim 1, further comprising motion actuation component adapted to rotate said shaft, said motion actuation component comprising a rotating member that supports said inner magnet, said rotating member comprising a hub, said shaft and said hub comprising complementary grooves adapted to allow the mutual coupling, said hub being at least partially made of said material having a hardness greater than or equal to 6.5 Mohs.

7. The pump, according to claim 5, wherein said coupling element and/or said hub are completely made of said material having a hardness greater than or equal to 6.5 Mohs.

8. The pump, according to claim 1, wherein said at least one support comprises at least one bush, said at least one bush being held in position inside a corresponding housing seat present in said pump body by a deformed portion of the material in which said pump body is made, said deformed portion of said pump body being deformed by a crimping tool or a riveting tool.

9. The pump, according to claim 1, wherein said material having a hardness greater than or equal to 6.5 Mohs also has one or more of the following properties:

Weibull modulus between 3 and 20;

Young's modulus greater than or equal to 50 GPa; and tensile strength at 20° C. greater than or equal to 30 MPa.

10. The pump, according to claim 1, wherein said material having a hardness greater than or equal to 6.5 Mohs also has one or more of the following properties:

thermal conductivity at 20° C. greater than or equal to 0.1 W/(m*K); and maximum operating temperature greater than or equal to 250° C.

* * * * *